United States Patent [19]

Gueret

[11] Patent Number: 4,974,612

[45] Date of Patent: Dec. 4, 1990

[54] BRUSH FOR APPLYING A MAKEUP PRODUCT

[75] Inventor: Jean-Louis Gueret, Paris, France

[73] Assignee: L'Oreal, Paris, France

[21] Appl. No.: 308,790

[22] Filed: Feb. 10, 1989

[30] Foreign Application Priority Data

Feb. 23, 1988 [FR] France ..... 88 02114

[51] Int. Cl.[5] ..... A45D 40/26

[52] U.S. Cl. ..... 132/218; 132/320; 401/122; 401/129

[58] Field of Search ..... 132/216, 218, 320; 401/122, 126, 129; 15/159 A, 206, 207, 182

[56] References Cited

U.S. PATENT DOCUMENTS

| | | | |
|---|---|---|---|
| 1,914,533 | 6/1933 | Schodde | 15/159 X |
| 2,580,378 | 12/1951 | Peterson et al. | 15/206 |
| 3,214,782 | 11/1965 | Masters et al. | 401/122 |
| 3,469,928 | 9/1969 | Widegren | 401/122 |
| 4,381,325 | 4/1983 | Masuda et al. | 15/159 X |
| 4,586,520 | 5/1986 | Brittain | 132/218 |
| 4,617,948 | 10/1986 | Gueret | 132/218 |
| 4,632,136 | 12/1986 | Kingsford | 132/218 |
| 4,671,689 | 6/1987 | Gueret | 132/218 |
| 4,705,053 | 11/1987 | Goncalves | 132/218 |

FOREIGN PATENT DOCUMENTS

| | | | |
|---|---|---|---|
| 0250680 | 1/1988 | European Pat. Off. . | |
| 1341026 | 9/1963 | France . | |
| 0007002 | of 1914 | United Kingdom | 15/206 |
| 0306713 | 2/1929 | United Kingdom | 15/206 |
| 833789 | 4/1960 | United Kingdom . | |

*Primary Examiner*—John J. Wilson
*Assistant Examiner*—Frank A. Laviola, Jr.
*Attorney, Agent, or Firm*—Cushman, Darby & Cushman

[57] ABSTRACT

A brush (1) includes a multitude of bristles (8) wedged in the spirals of at least two branches (9, 10) of a helically twisted metal wire that form the core of the brush. The bristles (8) of the brush have a flat cross section, that is, a section the long dimension of which is equal to at least twice the short dimension and at most equal to five times this short dimension, and the bristles (8) are corkscrewed.

6 Claims, 1 Drawing Sheet

BRUSH FOR APPLYING A MAKEUP PRODUCT

FIELD OF THE INVENTION

The invention relates to a brush for applying a makeup product, in particular for applying mascara to the eyelashes or dye to the hair, the brush being of the type of brushes that include a multitude of bristles wedged between or in the spirals of at least two branches of a helically twisted metal wire that forms the core of the brush.

BACKGROUND OF THE INVENTION

It is known that such brushes are intended to be placed in a product container that includes a wipe device in its upper portion. In present brushes, provided with bristles of circular cross section, the wiping effects the removal of the product over the zone of the bristles located radially past a given diameter, which depends in particular on the diameter of the passage in the wipe and the rigidity of the wipe. The bristles also generally form a substantially helicoid nappe, and the ends of the bristles are arranged in the form of a spiral, such that the eyelashes or hair cannot easily penetrate the interior of the nappe formed by the bristles of the brush. As a result, the makeup procedure is not always accomplished under good conditions, and may require a relatively large amount of time, if the makeup flaws resulting from the brush itself and from the manner in which it has been wiped are to be diminished.

OBJECT AND SUMMARY OF THE INVENTION

The primary object of the invention is to furnish a brush for applying a makeup product, of the type defined above, which no longer, or to a lesser degree, has the aforementioned disadvantages and which, in particular, after wiping retains bristles the ends of which are still filled with makeup products and upon use permits good spreading of the product. According to the invention, a brush for applying a makeup product, in particular for applying mascara to the eyelashes or dye to the hair, of the type defined above, is characterized in that the bristles of the brush have a flat cross section, that is, a section in which the long dimension is equal to at least twice the short dimension, and is equal to at most five times this short dimension, and that the bristles are corkscrewed or twisted.

Preferably, the corkscrewing of the bristles is obtained at the time of the clamping and helical twisting of the branches of the metal wire forming the core of the brush.

The bristles may have a rectangular cross section, especially with rounded edges. The short side of the rectangular section may have a dimension on the order of eight one-hundredths of a millimeter (0.08 mm), while the long side may have a dimension on the order of twenty one-hundredths of a millimeter (0.20 mm).

In a variant embodiment, the bristles of rectangular cross section may include, on at least one of their long faces corresponding to the long side of the cross section, at least one rib oriented substantially along the longitudinal direction of the bristle; the rib or ribs are not taken into consideration in the short dimension of the cross section of the bristle.

In another variant embodiment, the bristles have an oval cross section.

Because of the corkscrewing of the flat bristles, according to the invention, the long axis of the cross sections of the bristles is oriented differently over the entire length; the result is different flexibility of one bristle from another in a given direction, because of the different orientation of each bristle. The ends of these bristles are not arranged in the form of spiral, but rather diverge from one to the other. Moreover, the wiping of the flat bristles depends on their orientation, such that on the brush after wiping, bristles variously filled with the product can be found, in particular toward their end remote from the core.

In addition to the above-described arrangements, the invention comprises a certain number of other arrangements to be described in further detail below in terms of exemplary embodiments, described in conjunction with the accompanying drawings. These exemplary embodiments are in no way limiting.

DESCRIPTION OF THE PREFERRED EMBODIMENTS

Figure 1:
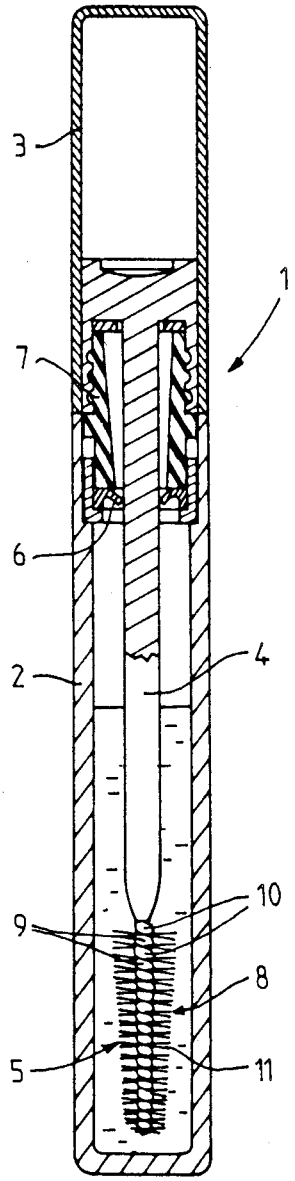
FIG. 1 is a view in axial section of a brush for applying a makeup product according to the invention, lodged in a container of the product.

Turning now to FIG. 1, a mascara applicator set 1 can be seen, including a container 2 that contains a product of liquid to pasty consistency. This container is topped with a cap 3, to which a rod 4 is connected that carries a brush 5 for applying the makeup product. A circular wiping lip 6 of flexible material is provided in the vicinity of an introduction passageway 7.

The brush 5 includes a multitude of bristles 8 wedged in the spirals of two branches 9, 10 of a metal wire that is helically twisted and forms the core of the brush.

Generally, for manufacture of the brush, the branches 9 and 10 are initially formed by parallel rectilinear branches of a U made by bending a wire, in particular an metal wire, by 180°. The bristles 8 are placed between the rectilinear branches so that their ends define a nappe located in a plane substantially orthogonal to the plane of these branches; the branches are then twisted, as shown in FIG. 1, so that between them they hold the bristles 8, the median portion of which is wedged between the spirals of the two branches 9 and 10.

Figure 2:
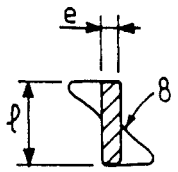
FIGS. 2–4 show various forms of cross section of flat bristles.
Figure 3:
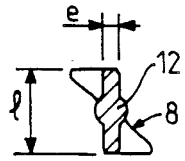
Figure 4:
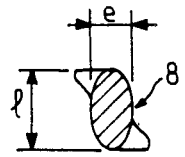

As FIGS. 2–4 show, the bristles 8 according to the invention have a flat cross section; that is, the long dimension 1 of this section is equal to at least twice the short dimension e, and is equal at most to five times this short dimension e. The following ratio applies: $2e \leqq 1 \leqq 5e$.

With the bristles 8 having a flat cross section of this type, upon clamping and twisting in a helix of the branches 9 and 10, each bristle 8 undergoes corkscrewing about its longitudinal axis; that is, its cross section rotates progressively along the direction of the length of the bristle, as has been shown in summary fashion in FIGS. 2–4. Because of this, the long axis of one cross section of the brush is oriented differently over the entire length of this bristle. The flexibilities of the bristles in a given direction are different, because of the different orientations of the cross sections.

The ends, such as 11, of the bristles 8, located radially toward the outside, do not precisely follow the form of a spiral, but rather diverge from one another.

The cross section of the bristles 8 may be rectangular, as shown in FIG. 2. Preferably, the corners are rounded. The short dimension e may be on the order of eight one-hundredths of a millimeters (0.08 mm), while the long dimension 1 of the cross section may be on the order of twenty one-hundredths of a millimeter (0.20 mm).

As a variant, the flat bristles of rectangular cross section may include, on at least one of their long faces, corresponding to the long side of the cross section, at least one rib, such as 12 (FIG. 3). This rib 12 may have a substantially semicircular cross section that is convex toward the outside. Preferably, one rib 12 is provided in the middle of each long face of the bristle. It is important to note that in the definition of a flat bristle, the dimension or thickness of the rib is not to be taken into consideration in determining the short dimension of the cross section; for this reason, the dimension e in FIG. 3 corresponds to the thickness of the bristle not counting the ribs 12.

The variant shown in FIG. 4 corresponds to bristles 8 that having an oval cross section, the short dimension e and the long dimension 1 of which meet the definition of the flat section provided above.

The wiping of a brush according to the prior art, including bristles of circular cross section, and the wiping of a brush according to the invention will now be compared. In a brush of the prior art, having bristles of circular cross section, the wiping takes place along a surface that is tangent to the inclined bristles, spiral by spiral, with one spiral pushing the next. The product with which the brush has been filled in the container 2 remains in the vicinity of the core formed by the branches 9 and 10; beyond a given diameter, depending on the diameter of the wipe 6 and on its flexibility, the bristles are practically completely emptied of the product.

With a brush according to the invention, including bristles 8 that are flat and corkscrewed, at the time of wiping the bristles that no longer true spirals are not folded down onto one another. Because of the different orientations of the cross sections of the bristles, the effects of the wiping will be different.

Figure 5:
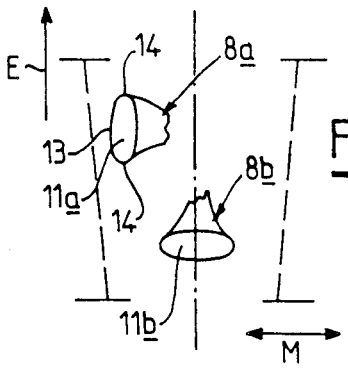
FIG. 5 is a simplified sectional view of bristles oriented differently in the brush, intended to facilitate the description relating to wiping and use.

Turning now to FIG. 5, a more-detailed description can be given. In this figure, two ends 11*a*, 11*b* of two bristles oriented differently are shown. The end 11*a* has a cross section of which the long dimension is substantially parallel to the axis of the brush and of the rod 4, while the end 11*b* has a cross section of which the long dimension is substantially orthogonal to the axis of the rod 4.

The wiping takes place when the brush is withdrawn from the container, that is, for a displacement of the brush and the bristles with respect to the wipe 6 along the direction of the arrow E, substantially parallel to the axis of the rod 4. Contrarily, upon being used and in the makeup process, the displacement of the brush and the bristles with respect to the eyelashes takes place substantially along the direction of the double arrow M, orthogonal to the axis of the rod 4.

When the brush is in the container 2, the bristles 8 fill with product in a substantially uniform manner along their entire length.

When the brush is withdrawn from the container 2 in the direction of the arrow E in FIG, 5, the wiping takes place by friction of the wipe 6 against the bristles.

For the bristles 8*a* having ends with cross sections oriented as shown at 11*a*, the friction of the wipe 6 will take place substantially along the zone 13, that is, along one long face of the cross section. The zones such as 14 corresponding to the short sides of the cross section virtually do not undergo wiping. In other words, on the face 13, a large amount of the product will be removed upon wiping, while on the faces 14, the wiping is slight, and the product remains on the bristle.

The bristles 8*b* having cross sections on the end oriented as with cross section 11*b* in FIG. 5 undergo more forceful wiping, because these bristles have relatively high flexibility in the direction e.

Finally, after the wiping, the brush will include bristles that are filled to various extents depending on their corkscrewing and on the orientation of the cross sections of the end.

When the brush is used for makeup, which is done with displacement substantially along the direction M, the bristles, such as 8*a*, have a relatively great flexibility in the direction M. The zones 14 of these bristles are filled with the product, so that these bristles assure the deposit of the product on the eyelashes, and the flexibility that they have is advantageous for this deposition.

The bristles such as 8*b* are in a sense hard, since they offer resistance to flexion in the direction M that is greater than that offered by the bristles 8*a*. These bristles 8*b* substantially contribute to combing the eyelashes while spreading and smoothing the product deposited by the bristles 8*a*.

It will be understood that the schematic diagram of FIG. 5 is a simplified diagram, and that in actuality a range of orientation of the scales may be found that varies between the two extreme orientations shown in FIG. 5. The description given is still applicable, with a modulation depending on the orientation of the cross section of the bristle in question.

The brush according to the invention makes it possible to obtain makeup having a novel appearance, and makes it possible to overcome the disadvantages, described at the outset above, that are particularly characteristic of brushes having bristles of circular cross section.

It will be understood that the definition of a flat section according to the invention encompasses cross sections having faces that are not necessarily plane, as is the case for the variants of FIGS. 3 and 4. Another variant, not shown in the drawing, may include a flat section in the form of a slight V, that is, in which one face forms a convex dihedron flaring widely, and the other face forms the corresponding concave dihedron.

What is claimed is:

1. A brush for applying a makeup product, in particular for applying mascara to the eyelashes or dye to the hair, including a metal wire having at least two branches which are helically twisted to form spirals and a plurality of bristles held in said spirals with said twisted wire forming the core of the brush, wherein the bristles of the brush have a flat cross section with a long dimension and a short dimension with said long dimension being between at least twice the short dimension and at most five times the short dimension, and the bristles having a longitudinal axis and each being twisted about said axis.

2. A brush as defined by claim 1, wherein the bristles have a rectangular cross section and include a long side and a short side.

3. A brush as defined by claim 2, wherein the corners of the rectangular cross section are rounded.

4. A brush as defined by claim 3, wherein the short side of the rectangular cross section has a dimension on the order of eight one-hundredths of a millimeter, while the long side has a dimension on the order of twenty one-hundredths of a millimeter.

5. A brush as defined in claim 2, wherein the bristles of rectangular cross section include, on at least one of their long faces corresponding to the long side of the cross section, at least one rib oriented substantially along the longitudinal axis of the bristle, without the rib contributing to the short dimension on the cross section of the bristle.

6. A brush as defined by claim 1, wherein the bristles have an oval cross section.

* * * * *